US007634826B2

(12) United States Patent
Koch

(10) Patent No.: US 7,634,826 B2
(45) **Date of Patent: *Dec. 22, 2009**

(54) PATIENT BED SYSTEM

(75) Inventor: Guido Koch, Karlsruhe (DE)

(73) Assignee: Maquet GmbH & Co. KG, Rastatt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/598,527

(22) Filed: Nov. 13, 2006

(65) Prior Publication Data

US 2007/0107124 A1 May 17, 2007

(30) Foreign Application Priority Data

Nov. 14, 2005 (DE) ..... 10 2005 054 224

(51) Int. Cl.
*A61G 7/08* (2006.01)

(52) U.S. Cl. ..... 5/600; 5/86.1

(58) Field of Classification Search ..... 5/600, 5/86.1, 81.1 R, 83.1, 611, 11, 411; 403/326
See application file for complete search history.

(56) References Cited

U.S. PATENT DOCUMENTS 566,521 A 8/1896 Leger
1,740,906 A 12/1929 Rothauszky et al.
2,416,410 A 2/1947 Shampaine
2,763,320 A 9/1956 Schram
2,764,459 A 9/1956 McDonald
2,771,330 A 11/1956 Zaalberg
2,775,496 A 12/1956 Berggren
2,816,806 A 12/1957 Zaalberg
2,995,762 A * 8/1961 Albinson ..... 5/411

(Continued)

FOREIGN PATENT DOCUMENTS

DE 264297 8/1912

(Continued)

OTHER PUBLICATIONS

European Search Report for Serial No. EP 06 12 3598 dated Feb. 8, 2007.

(Continued)

*Primary Examiner*—Robert G Santos
(74) *Attorney, Agent, or Firm*—McCormick, Paulding & Huber LLP

(57) ABSTRACT

In a patient bed system, comprising a patient bed, a support column for supporting the bed and a trolley for transporting the bed, the bed having arranged on it first coupling elements (22) which are intended for selective connection to second or third coupling elements (24, 26) on the support column and on the trolley respectively, the first coupling elements (22) have in each case an outer contour (38) and a clearance (40) with an inner contour (42), the second or the third coupling elements (24, 26) being designed in each case as guide tenons which have an outer contour (58) adapted to the inner contour (42) of the clearance (40) of the first coupling elements (22) and which are intended for engagement into the clearance (40), and the third or the second coupling elements (26, 24) having in each case a clearance intended for receiving a first coupling element (22) and having an inner contour (50) adapted to the outer contour (38) of the first coupling elements (22).

9 Claims, 5 Drawing Sheets

U.S. PATENT DOCUMENTS

| | | | | |
|---|---|---|---|---|
| 3,226,734 | A | 1/1966 | Convention | |
| 3,238,539 | A | 3/1966 | Koch | |
| 3,302,218 | A | 2/1967 | Stryker | |
| 3,328,079 | A | 6/1967 | Byczkowski et al. | |
| 3,379,877 | A | 4/1968 | Makino et al. | |
| 3,388,700 | A | 6/1968 | Mountz | |
| 3,868,103 | A | 2/1975 | Pageot et al. | |
| 4,101,120 | A | 7/1978 | Seshima | |
| 4,176,415 | A | 12/1979 | Dickerson et al. | |
| 4,244,358 | A | 1/1981 | Pyers | |
| 4,597,119 | A | 7/1986 | Padgett | |
| 4,640,482 | A | 2/1987 | Rogers | |
| 5,031,547 | A | 7/1991 | Hirose | |
| 5,083,331 | A | 1/1992 | Schnelle et al. | 5/60 |
| 5,220,698 | A | 6/1993 | Hannant | |
| 5,279,011 | A | 1/1994 | Schnelle | |
| 5,477,570 | A * | 12/1995 | Hannant et al. | 5/86.1 |
| 5,544,376 | A | 8/1996 | Fromson | |
| 5,564,852 | A | 10/1996 | Maxwell et al. | |
| 5,611,638 | A * | 3/1997 | Dorr et al. | 403/327 |
| 5,615,431 | A | 4/1997 | Vassilli | |
| 5,621,932 | A * | 4/1997 | Strachan | 5/600 |
| 5,649,833 | A | 7/1997 | Pfeuffer et al. | |
| 5,651,150 | A * | 7/1997 | Kanitzer et al. | 5/600 |
| 5,659,909 | A | 8/1997 | Pfeuffer et al. | |
| 5,754,997 | A | 5/1998 | Lussi et al. | |
| 5,787,528 | A | 8/1998 | Antinori | |
| 5,790,996 | A | 8/1998 | Narfstrom | |
| 5,969,488 | A | 10/1999 | Fromson | |
| 6,008,598 | A | 12/1999 | Luff et al. | |
| 6,073,284 | A | 6/2000 | Borders | |
| 6,095,713 | A | 8/2000 | Doyle et al. | |
| 6,351,678 | B1 | 2/2002 | Borders | |
| 6,390,927 | B1 | 5/2002 | Cleveland, III | |
| 6,396,224 | B1 | 5/2002 | Luff et al. | |
| 6,484,334 | B1 | 11/2002 | Borders et al. | |
| 6,560,492 | B2 | 5/2003 | Borders | |
| 6,565,156 | B1 | 5/2003 | Yamashita et al. | |
| 6,609,260 | B2 | 8/2003 | Hand et al. | |
| 6,619,872 | B2 | 9/2003 | Crorey et al. | |
| 6,722,289 | B2 | 4/2004 | Kato | |
| 6,862,761 | B2 | 3/2005 | Hand et al. | |
| 6,971,131 | B2 | 12/2005 | Bannister | |
| 6,986,179 | B2 | 1/2006 | Varadharajulu | |
| 7,010,369 | B2 | 3/2006 | Borders et al. | |
| 7,068,143 | B2 | 6/2006 | Doering et al. | |
| 7,089,612 | B2 | 8/2006 | Rocher et al. | |
| 7,181,791 | B2 * | 2/2007 | Clayton | 5/600 |
| 7,235,942 | B2 | 6/2007 | Nagaoka et al. | |
| 7,321,811 | B1 | 1/2008 | Rawls-Meehan | |
| 7,346,944 | B2 | 3/2008 | Shaw | |
| 7,367,740 | B2 | 5/2008 | Lazic et al. | |
| 7,398,790 | B2 | 7/2008 | Glatz | |
| 7,526,823 | B2 * | 5/2009 | Koch | 5/600 |
| 2002/0111701 | A1 | 8/2002 | Borders | |
| 2002/0170115 | A1 | 11/2002 | Borders et al. | |
| 2003/0078144 | A1 | 4/2003 | Gehrke | |
| 2003/0195644 | A1 | 10/2003 | Borders et al. | |
| 2004/0006821 | A1 | 1/2004 | Hand et al. | |
| 2004/0074003 | A1 | 4/2004 | Bannister | |
| 2004/0172757 | A1 | 9/2004 | Somasundaram | |
| 2007/0107123 | A1 | 5/2007 | Koch | |
| 2007/0107124 | A1 * | 5/2007 | Koch | 5/510 |
| 2007/0107125 | A1 | 5/2007 | Koch | |
| 2007/0107126 | A1 | 5/2007 | Koch | |
| 2007/0107129 | A1 | 5/2007 | Burstner | |
| 2007/0110448 | A1 | 5/2007 | Ruch | |
| 2007/0116512 | A1 | 5/2007 | Katzenstein | |
| 2007/0118989 | A1 | 5/2007 | Koch | |
| 2009/0119842 | A1 * | 5/2009 | Koch | 5/600 |

FOREIGN PATENT DOCUMENTS

| | | | |
|---|---|---|---|
| DE | 4229318 | C1 | 9/1993 |
| DE | 296 10 726 | U1 | 9/1996 |
| DE | 197 32 467 | A1 | 2/1999 |
| DE | 197 51 320 | A1 | 5/1999 |
| DE | 199 19 496 | A1 | 11/2000 |
| DE | 102 53 878 | A1 | 5/2004 |
| DE | 102 53 906 | A1 | 6/2004 |
| EP | 0 457 246 | A1 | 5/1991 |
| EP | 0 457 246 | A1 | 11/1991 |
| EP | 0625348 | A1 | 11/1994 |
| EP | 0832603 | A1 | 4/1998 |
| EP | 0 913 139 | A1 | 5/1999 |
| FR | 2388546 | | 11/1978 |
| GB | 1 321 193 | | 6/1973 |
| GB | 2260075 | A | 4/1993 |
| GB | 2 277 870 | A | 11/1994 |
| WO | 99 28146 | A1 | 6/1996 |
| WO | 02 055001 | A1 | 7/2002 |
| WO | 03 086263 | A | 10/2003 |

OTHER PUBLICATIONS

European Search Report for Serial No. EP 06 12 3443 dated Feb. 7, 2007.

European Search Report for Serial No. EP 06 12 3593 dated Dec. 4, 2007.

European Search Report for Serial No. EP 06 12 3596 dated Sep. 7, 2007.

European Search Report for Serial No. EP 06 12 3719 dated Sep. 7, 2007.

European Search Report for Serial No. EP 06 12 3592 dated Nov. 29, 2007.

European Search Report for Application No. EP 06 12 3721, dated Jun. 20, 2008.

European Search Report for Application No. EP 06 12 3444, dated Aug. 22, 2008.

* cited by examiner

PATIENT BED SYSTEM

CROSS REFERENCE TO RELATED APPLICATIONS

Applicant hereby claims foreign priority benefits under U.S.C. § 119 from German Patent Application No. 10 2005 054 224.7 filed on Nov. 14, 2005, the contents of which are incorporated by reference herein.

FIELD OF THE INVENTION

The invention relates to a patient bed system, comprising a patient bed, a support column for supporting the bed and a trolley for transporting the bed, the bed having arranged on it first coupling elements which are intended for selective connection to second or third coupling elements on the column and on the trolley respectively.

BACKGROUND OF THE INVENTION

Such a system is known, for example, from EP 457 246 B1. To transfer the bed onto the trolley, the latter is brought into a suitable position in relation to the support column. By means of the downward movement of the height adjustment device of the support column, the bed is first lowered, until it lies on the trolley. At the moment of transfer the first coupling elements on the bed are simultaneously in engagement with the second and third coupling elements on the column and on the trolley respectively. In the known solution, the arrangement is in this instance such that in each case a second and a third coupling element bear against one another and between them enclose a first coupling element which engages into mutually confronting clearances in the second and the third coupling element. Since the coupling elements have to absorb a high load and are therefore of correspondingly stable design, this arrangement requires a relatively large amount of space.

SUMMARY OF THE INVENTION

The object on which the invention is based is to design an arrangement of the type mentioned so as to be more space-saving, whilst at the same time ensuring high functional reliability.

This object is achieved, according to the invention, in that the first coupling elements have in each case an outer contour and a clearance with an inner contour, in that the second or the third coupling elements are designed in each case as guide tenons which have an outer contour adapted to the inner contour of the clearance of the first coupling elements and which are intended for engagement into the clearance, and in that the third or the second coupling elements have in each case a clearance intended for receiving a first coupling element and having an inner contour adapted to the outer contour of the first coupling elements.

The result of the coupling elements being designed according to the invention is that, at the moment of transfer of the bed from the trolley onto the support column, or vice versa, that is to say when all three coupling elements are simultaneously in engagement with one another, the coupling elements are nested one in the other such that they lie at least approximately in one plane. This affords a highly space-saving arrangement transversely to the longitudinal direction of the bed.

Preferably, the third coupling elements are formed by tenons arranged on legs of the trolley, whilst the second coupling elements are formed by reception pockets configured on the support column. The first coupling elements therefore engage into the reception pockets of the second coupling elements when the bed is connected to the support column and, conversely, receive in their clearance the tenons on the legs of the trolley when the bed lies on the trolley.

To increase safety in the transfer of the bed from the column onto the trolley, or vice versa, it is advantageous if the column has arranged on it at least one centring pin which is intended for engagement into a complementary clearance on the bed or on a part fixed to the bed, the arrangement being such that the centring pin prolongs the zone of engagement of the coupling elements.

In order to prevent the bed from being inadvertently lifted out of the connection to the support column or the trolley as long as the bed is not connected to the other part taking it over in each case, locking means are provided in a way known per se on at least one of the coupling elements, in order to lock the first coupling elements alternatively to the second or third coupling elements when the bed is coupled to the column or to the trolley.

In the patient bed system known from EP 457 246 B1, the coupling elements of the bed are assigned two spring-loaded locking bolts, of which one locking bolt latches in the coupling element of the column when the bed lies on the column and the other locking bolt latches in the coupling element of the trolley when the bed lies on the trolley. In the case of the take-over operation, for example from the trolley onto the column by means of an upward movement of the column, the locking bolt latched in the coupling element of the trolley is pressed back by a control contour of the column and consequently unlocks the bed on the trolley. At the same time, the presence of the trolley initially prevents the latching of the other locking bolt in the coupling element of the column. Only by the bed being lifted out of the trolley can the second locking bolt latch into the coupling element of the column under spring prestress at an increasing distance from the coupling element of the trolley. Conversely, the locking bolt latched in the coupling element of the column is pressed back by a control contour of the trolley, whilst the other locking bolt latches in the coupling element of the trolley under the action of the spring force at an increasing distance of the column from the bed. At the moment of take-over, that is to say when the coupling element of the column and the coupling element of the trolley are in engagement with the coupling element of the bed, the bed is not protected by any locking bolt against being lifted out. Moreover, situations may arise in which the locking bolts are prevented from snapping in under spring force, for example if the coupling elements are tilted slightly with respect to one another.

In order to eliminate this problem and increase the safety of the patient bed system, it is proposed, according to the invention, that the locking means comprise at least one locking element which is arranged adjustably on one of the coupling elements and which, in the engagement position of two coupling elements, engages into a clearance of the coupling element adjacent in each case, and that the coupling elements have formed on them control cams, by means of which, during the operation of transferring the bed from the support column onto the trolley, or vice versa, the locking element is shifted positively into the respective clearance or is shifted out of the latter. Preferably, in this case, the respective locking element is designed as a two-armed rotatably mounted lever which has control edges which are intended to interact with the control cams and which are arranged opposite to the fulcrum of the lever, that is to say on the two lever arms.

The result of the embodiment according to the invention is that the respective locking element does not assume its latching position by spring pressure, but, instead, is guided into it positively. At the same time, during the transfer operation, that is to say during the movement of the locking element, the bed is always trapped between the oppositely oriented control edges and therefore, even at the time of take-over, is secured against being lifted out of the respective coupling element.

Preferably, similarly to the known patient bed system described above, in the solution according to the invention, too, each first coupling element has arranged on it two locking elements, of which one is intended for locking the first coupling element to the second coupling element and the other is intended for locking the first coupling element to the third coupling element, the control cams being designed for adjusting the locking elements on the second and third coupling elements.

In order to ensure a satisfactory and as far as possible constraint-free transfer of the bed from the trolley onto the column, and vice versa, the coupling elements should be aligned exactly with one another before transfer, so that they can slide one into the other, as far as possible free of constraint. This presupposes that the column head, which, of course, as a rule, can be adjusted to vary the position of the patient on an operating table, is in an exactly defined position in relation to the floor of the operating theatre on which the trolley stands. Also, for any reason, the position of the patient bed on the trolley may not be exactly parallel to the floor of the operating theatre. Since these deviations sometimes cannot be detected or cannot so quickly be detected by the naked eye, it is proposed, according to the invention, that at least one of the coupling elements located on the support-column side has provided on it at least one sensor for sensing the position of a first coupling element connected to the bed in relation to the column-side coupling element, the sensor taking effect when the bed is located on the trolley and the latter assumes in relation to the support column a specific position for transferring the bed onto the latter. Expediently, the sensor is connected to a control controlling the actuating drive of the column head. When the sensor detects a deviation from the desired alignment of the bed-side coupling elements in relation to the column-side coupling elements or the coupling elements on the trolley, then the control, in response to a corresponding signal from the sensor, causes an adjustment of the column head until the coupling elements are exactly in alignment with one another. The sensor may be formed, for example, by a deflectable finger which senses one of the contours of the bed-side or trolley-side coupling elements.

BRIEF DESCRIPTION OF THE DRAWINGS

The following description explains the invention by means of exemplary embodiments, in conjunction with the accompanying drawings in which.

DETAILED DESCRIPTION OF THE INVENTION

Figure 1:
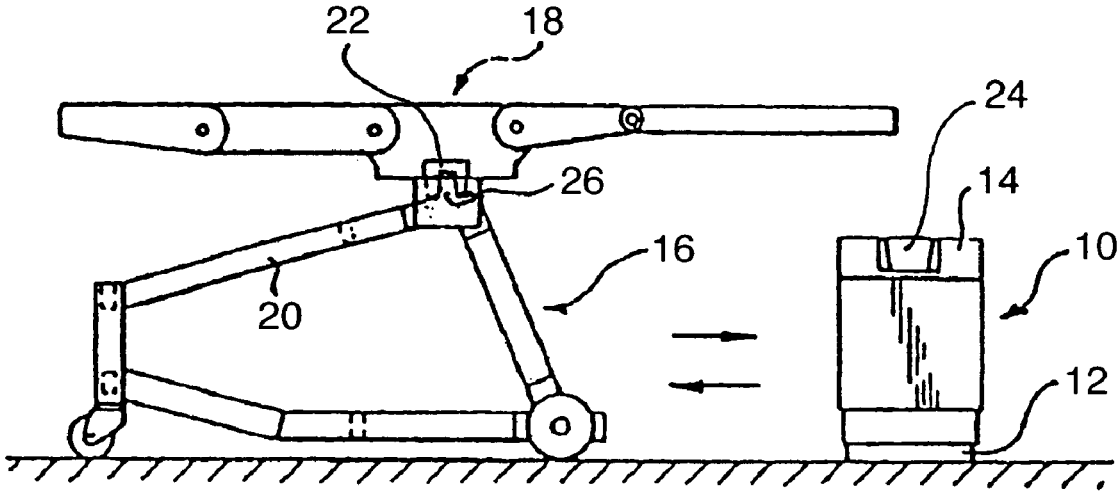
FIG. 1 shows a diagrammatic illustration of a patient bed system comprising a patient bed, a trolley for a bed and a support column for a patient bed.

The patient bed system, illustrated diagrammatically in FIG. 1, comprises a support column, designated in general by 10, of an operating table, with a column foot 12 and with a column head 14 mounted vertically adjustably on the latter. The height adjustment device is not illustrated. It may be designed in any conventional way. As a rule, this may be a hydraulic or mechanical lifting device.

Located on the left, next to the support column, is a trolley, designated in general by 16, which carries a bed or table board 18 of the operating table. The trolley 16 comprises two side frame parts 20 which are connected to one another by means of crosspieces, not illustrated, as is illustrated in EP 457 246 B1. The trolley 16 can be moved up to the support column 10 such that the latter lies between the side frame parts 20.

On the longitudinal side edges of the bed 18, first coupling elements 22 are arranged, which are intended for engagement into second coupling elements 24 on the column head 14 or third coupling elements 26 on the side frame parts 20 of the trolley 16, in order to connect the bed 18 either to the support column 10 or to the trolley 16. The more detailed configuration of the coupling elements and their mode of operation will now be described in more detail below.

Figure 2:
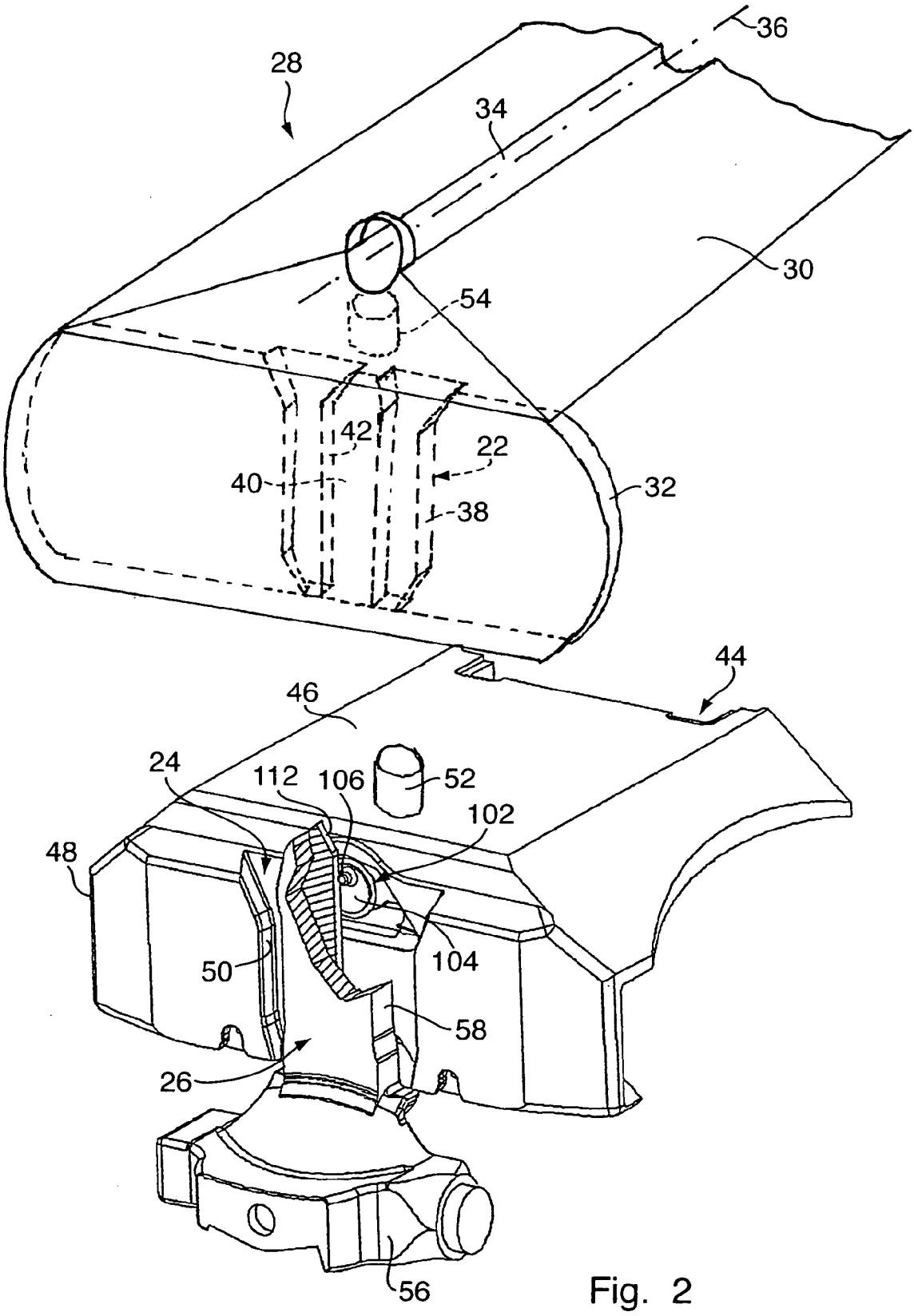
FIG. 2 shows a partially diagrammatic illustration of the three coupling elements cooperating with one another.

In FIG. 2, 28 designates a connecting frame which comprises a middle plate 30 and two side cheeks 32 which project downward at its longitudinal ends and only one of which is illustrated. The middle plate 30 has on its top side bedding 34 for connection to the actual patient bed 18 which is mounted on the connecting frame 28 pivotably about the bedding axis 36 running transversely with respect to the longitudinal direction of the said patient bed. Each of the cheeks 32 carries on its inside a first coupling element 22. The latter has the configuration of a broad tenon with an outer contour 38, and also a slot-shaped clearance 40 with an inner contour 42.

Below the connecting frame 28 is located a saddle 44, illustrated only partially, which is part of the column head 14. It is of C-shaped construction, in a similar way to the connecting frame 28, with a middle web 46 and with two side parts 48, only one of which is illustrated. The side part 48 has on its outside a reception pocket, forming the second coupling element 24, for receiving the first coupling element 22, the reception pocket having an inner contour 50 adapted to the outer contour 38 of the first coupling element 22. The middle web 46, near its respective side part 48, carries on its top side a centring pin 52 which is intended for engagement into a complementary pin receptacle 54 formed on the underside of the middle plate 30 of the connecting frame 28.

In the illustration of FIG. 2, there projects into the reception pocket of the second coupling element 24 a guide tenon which forms the third coupling element 26 and which is fastened to the trolley 16 via a pedestal 56 and is intended for engagement into the clearance 40 of the respective first coupling element 22. The said guide tenon has an outer contour 58 corresponding to the inner contour 42 of the first coupling element 22.

Figure 3:
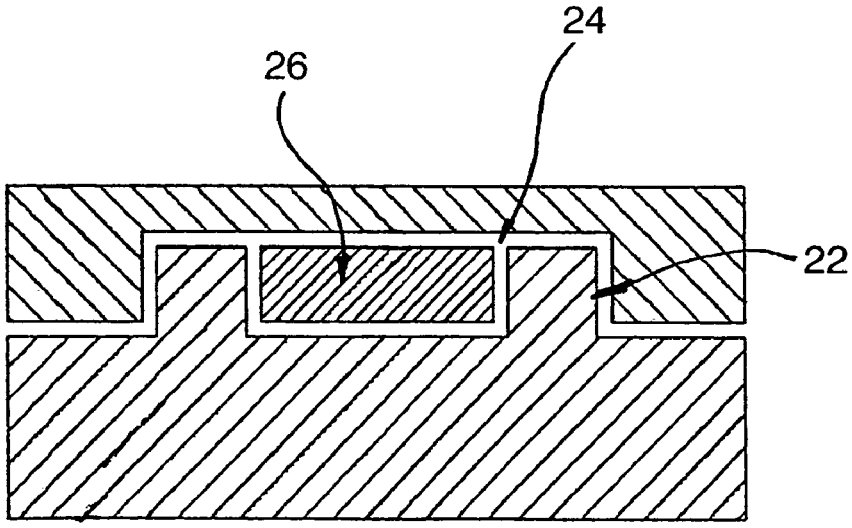
FIG. 3 shows a diagrammatic section through the three coupling elements simultaneously in engagement with one another.

If all three coupling elements 22, 24, 26 are simultaneously in engagement with one another during the transfer of the bed from the trolley onto the support column, and vice versa, they are nested one in the other, as may be seen in the diagrammatic illustration of FIG. 3. The tenon forming the third coupling element 26 lies in the clearance 40 of the first coupling element 22 which, in turn, engages into the reception pocket forming the second coupling element 24, so that all three coupling elements lie as it were in one plane. This results in a type of construction which is very flat transversely with respect to the longitudinal direction of the bed 18.

The further benefits of this arrangement may be gathered from the following description of the locking mechanism, by means of which the bed 18 is connected alternately either to the column head 14 or to the trolley 16.

Figure 4:
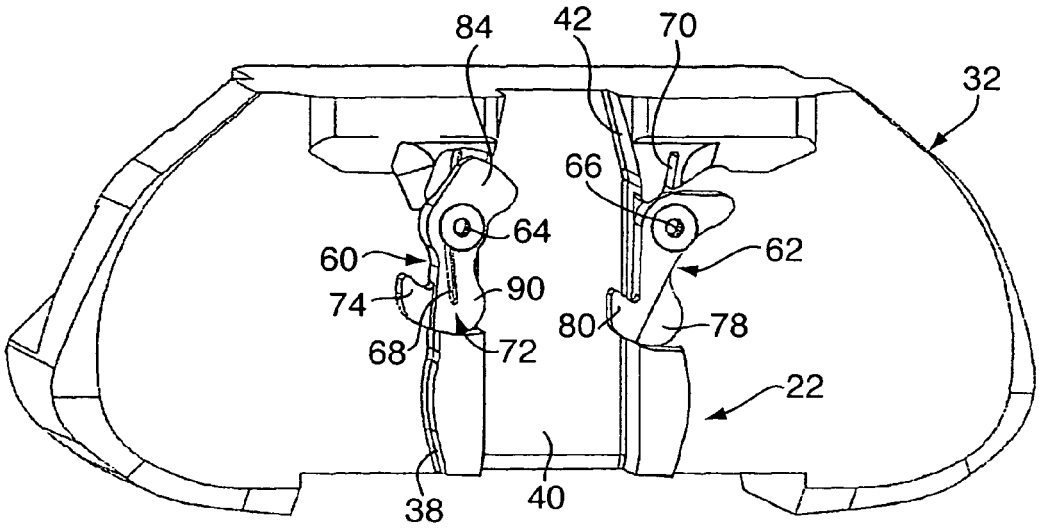
FIG. 4 shows a partially diagrammatic illustration of a first coupling element alone, which is arranged on a bed-side part.
Figure 5:
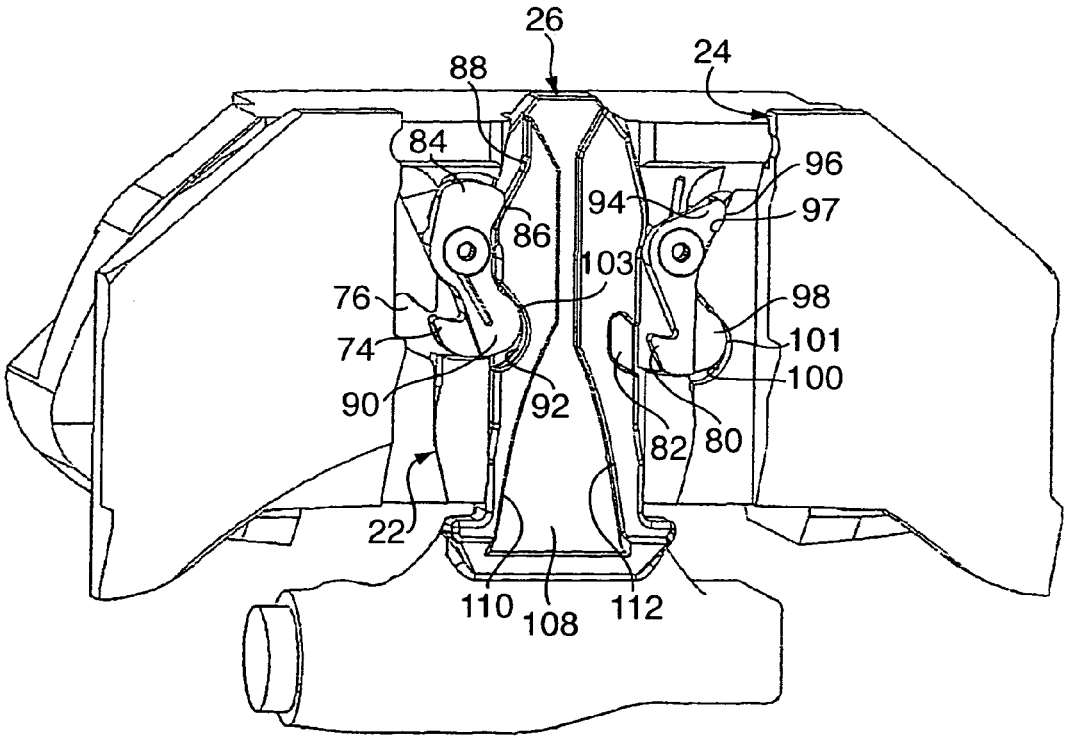
FIG. 5 shows a diagrammatic illustration of the three coupling elements simultaneously in engagement with one another.

FIG. 4 shows a diagrammatic top view of the inside of a cheek 32 of the connecting frame 28. The first coupling element 22, on which two locking elements 60 and 62 are mounted adjustably, can be seen once again. The locking elements 60 and 62 are designed in each case in the form of a two-armed lever which is mounted pivotably about a pivot axis 64 or 66 and which is prestressed in each case clockwise by means of a torsion spring 68 or 70. The locking element 60 is intended for locking the bed 18 to the column head 14. For this purpose, one lever arm 72 is provided with a hooked extension 74 which is intended for engagement into a clearance 76 on the inner contour 50 of the second coupling element 24 (FIG. 5). The locking element 62 is intended for locking the bed 18 to the trolley 16. For this purpose, the lever arm 78 of the locking element 62 has a hooked extension 80 which is intended for engagement into a clearance 82 on the outer contour 58 of the tenon-shaped third coupling element 26 (FIG. 5).

The mode of operation of the locking elements during the transfer of the bed 18 from the column 10 onto the trolley 16 will now be described with reference to FIG. 5 to 7.

FIG. 5 shows the three coupling elements 22, 24 and 26 in complete engagement with one another. In this state, both locking elements 60 and 62 are pivoted into their release position. In the case of the locking element 60, this takes place in that the lever arm 84 opposite to the lever arm 72 slides with control edge 86 on a control cam 88 formed on the third coupling element 26 and is at the same time pivoted anti-clockwise, that end 90 of the first lever arm 72 which is opposite to the hooked extension 74 of the first locking element 60 penetrating into a semicircular clearance 92 in the outer contour of the third coupling element, as shown in FIG. 5. In the same way, the second locking element 62 is pivoted anti-clockwise, in that a lever arm 94 opposite to the lever arm 78 slides with a control edge 96 on a control cam 97 formed on the second coupling element 24, once again that end 98 of the first lever arm 78 which is opposite to the hooked extension 80 penetrating into a semicircular clearance 100 in the second coupling element 24, as shown in FIG. 5.

Figure 6:
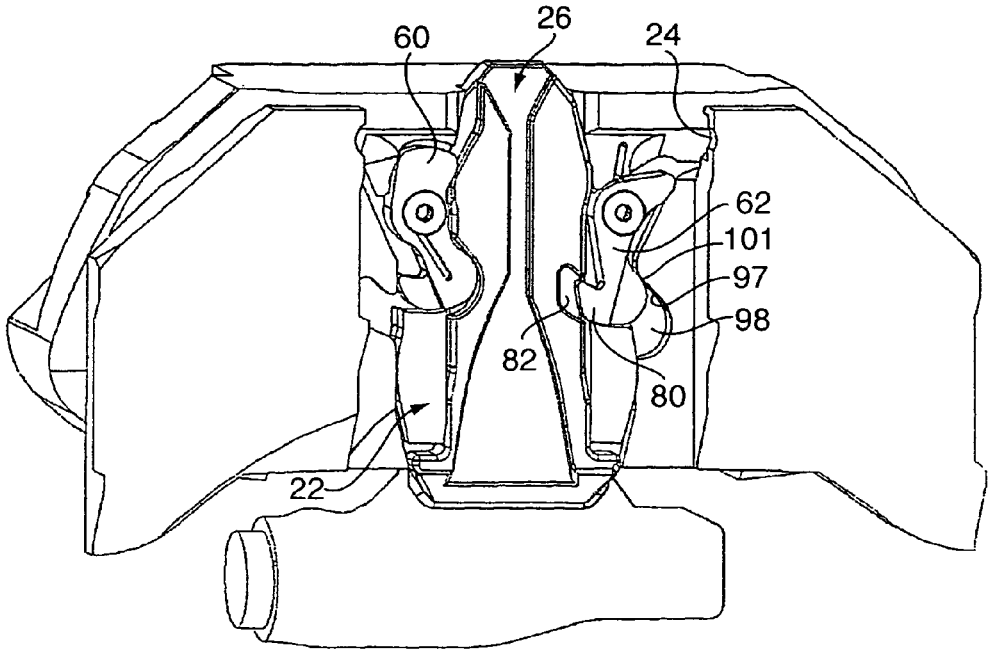
FIGS. 6 and 7 show in each case an illustration of the three coupling elements during the transfer of the bed from the support column onto the trolley.
Figure 7:
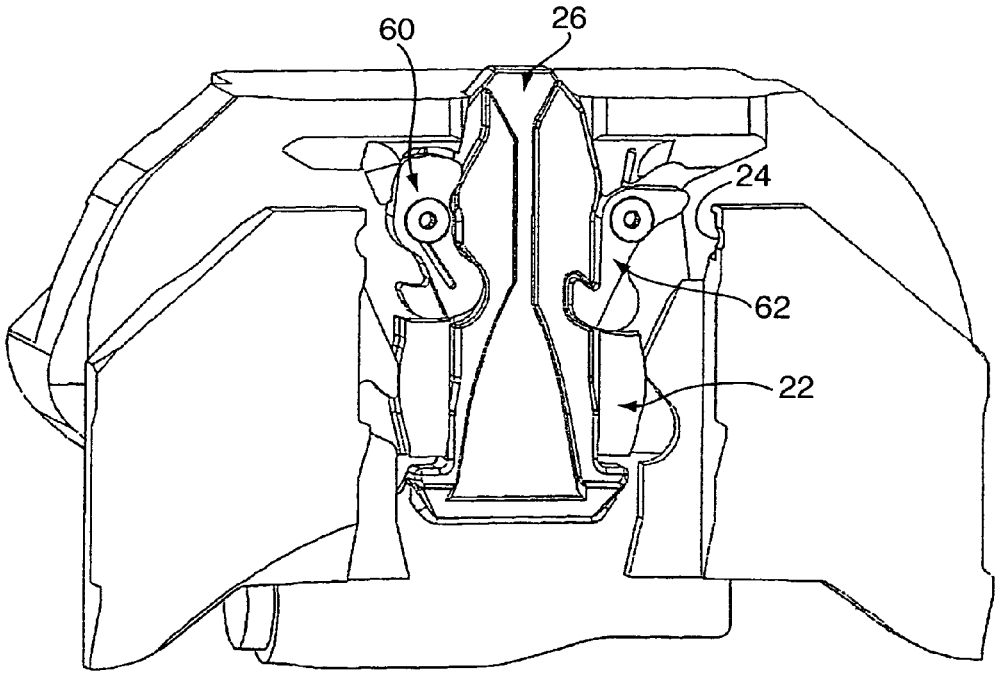

During the transfer of the bed 18 onto the trolley 16, the column head 14 of the support column 10 is lowered out of the position illustrated in FIG. 5, as can be seen in FIGS. 6 and 7. FIG. 6 shows that, with the commencement of the downward movement of the column head 14 and consequently of the second coupling element 24, the right-hand locking element 62 is pivoted clockwise under the action of the control cam 97, sliding on a control edge 101 of the lever end 98, of the second coupling element 24, so that the hooked extension 80 is moved into the clearance 82. Even in the position illustrated in FIG. 6, the bed 18 could no longer be lifted off from the trolley 16. When the column head 14 is lowered further, as shown in FIG. 7, the hooked extension 80 of the second locking element 62 is pivoted completely into the clearance 82 in the third coupling element 26, so that the bed 18 is locked firmly to the trolley 16. In this position, the hooked extension 80 is held as a result of the action of the torsion spring 70. Conversely, during the raising of the column head 14 out of the position illustrated in FIG. 7, the locking element 62 would be pivoted anti-clockwise, so that the lock between the first and the third coupling element is cancelled.

Figure 8:
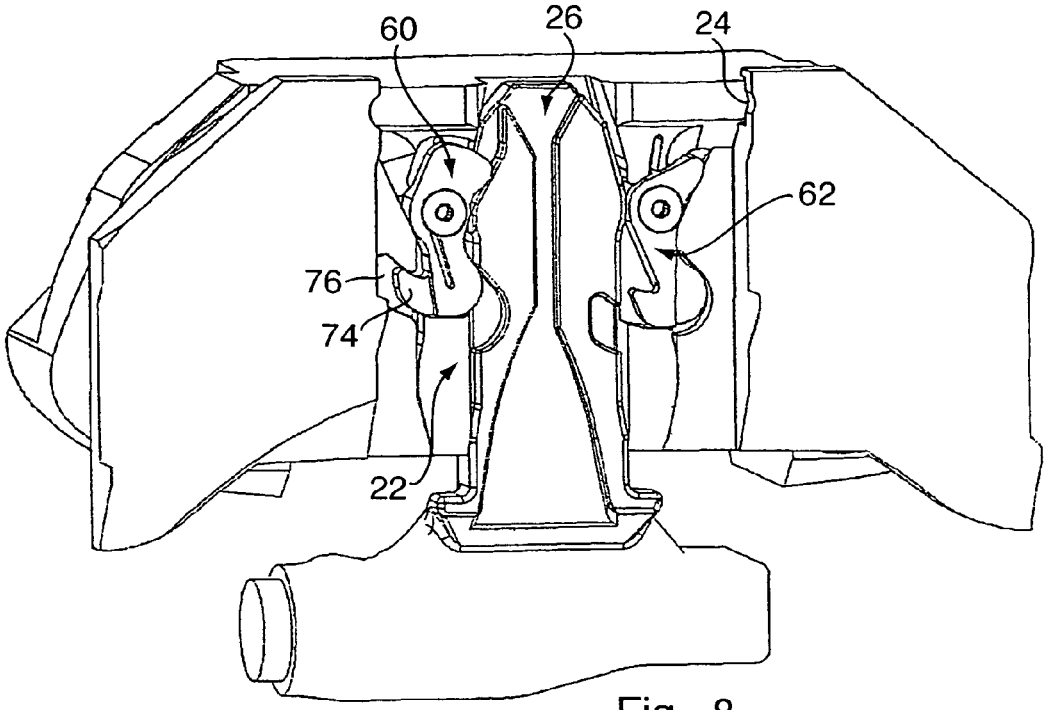
FIGS. 8 and 9 show in each case illustrations, corresponding to FIG. 6 and 7, during the transfer of the bed from the trolley onto the support column.
Figure 9:
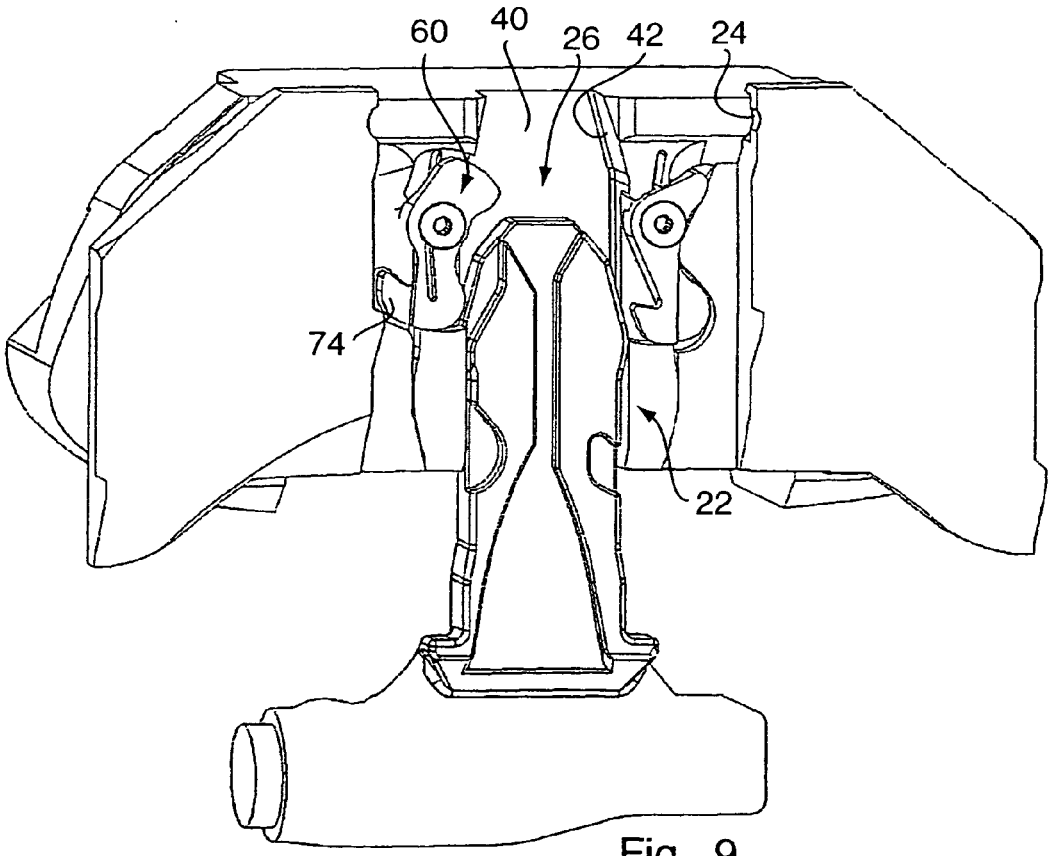

FIG. 8 and 9 show the locking operation during the transfer of the bed 18 from the trolley 16 onto the support column 10. In this case, starting from the position illustrated in FIG. 5, the column head 14 is raised, so that the third coupling element 26 slides downward out of the clearance 40 of the first coupling element 22. At the same time, in this case, the first locking element 60 is positively pivoted clockwise by the control cam 88 sliding on a control edge 103 on the lever end 90 and located on the third coupling element 26, so that the hooked extension 74 of the first locking element 60 engages into the clearance 76 in the column-side second coupling element 24, as shown in FIG. 8. When the third coupling element is drawn out of the first coupling element, the bed 18 is locked firmly to the column head 14, as shown in FIG. 9. Conversely, when the third coupling element 26 is introduced into the clearance 40 of the first coupling element 22, the locking element 60 is pivoted anti-clockwise, so that the lock between the second and the first coupling element is released. The above description shows that the two locking elements 60 and 62 are in each case pivoted positively during the coupling operations, so that a reliable lock between the bed and the column head, on the one hand, and the bed and the trolley, on the other hand, is ensured.

It can be seen, furthermore, that, starting from the position according to FIG. 5, in which both locking elements 60 and 62 are pivoted into their release position, if the bed 18 were raised with respect to the column head and the trolley, both locking elements would be pivoted clockwise and consequently be locked. The bed 18 is thus reliably prevented from being lifted out of the position illustrated in FIG. 5.

In order to achieve an as far as possible friction-free transfer of the bed from the column onto the trolley, or vice versa, the coupling elements 22, 24 and 26 should lie exactly in alignment with one another. If they are tilted with respect to one another, malfunctions may occur. In order to avoid this, the saddle 44 has arranged on it, within the reception pocket of the second coupling element 24, a sensor, designated in general by 102, which is intended to sense the position of the third coupling element 26 in relation to the second coupling element 24. The sensor comprises a rotatably mounted disc 104 which is connected, for example, to a potentiometer tap and on the outside of which is provided an eccentrically arranged sensing finger 106. This sensing finger 106 engages into a clearance 108 which is formed on a wide side of the third coupling element 26 and which is delimited by two control edges 110 and 112. If the transport trolley 16 and the column head 14 are inclined with respect to one another during the take-over operation, so that the coupling elements 24 and 26 are not aligned with one another in the desired form, the sensing finger 106 butts against one of the control edges 110, 112. The disc 104 is thereby rotated. This rotation is detected, for example, via the connected potentiometer and can be converted into a control signal which is supplied, in turn, to the control of the column head 14. The column head 14 can thereby be adjusted such that the second and the third coupling element are aligned with one another, in order to allow friction-free coupling.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A patient bed system, comprising a patient bed, a support column for supporting the bed and a trolley for transporting the bed, the bed having arranged on it first coupling elements which are intended for selective connection to second or third coupling elements on the support column and on the trolley respectively, wherein the first coupling elements have in each case an outer contour and a clearance with an inner contour, in that the second or the third coupling elements are designed in each case as guide tenons which have an outer contour adapted to the inner contour of the clearance of the first coupling elements and which are intended for engagement into the clearance, and in that the third or the second coupling elements have in each case a clearance intended for receiving a first coupling element and having an inner contour adapted to the outer contour of the first coupling elements, wherein at least one of the coupling elements located on the support-column side has provided on it at least one sensor for sensing the position of a first coupling element connected to the bed in relation to the column-side coupling element, the sensor taking effect when the bed is located on the trolley and the latter assumes in relation to the support column a specific position for transferring the bed onto the latter, wherein the sensor is formed by a deflectable finger for sensing one of the contours of the bed-side or trolley-side coupling elements.

2. The patient bed system according to claim 1, wherein the support column has arranged on it at least one centring pin which is intended for engagement into a complementary clearance on the bed, the arrangement being such that the centring pin prolongs the zones of engagement of the coupling elements.

3. The patient bed system according to claim 1, wherein the third coupling elements are formed by tenons arranged on legs of the trolley.

4. The patient bed system according to claim 1, wherein the second coupling elements are formed by reception pockets configured on the support column.

5. The patient bed system according to claim 1, wherein locking means are provided on at least one of the coupling elements, and wherein at least one of the coupling elements has a control cam formed thereon, by means of which, during the operation of transferring the bed from the support column onto the trolley, or vice versa, the locking means are shifted, in order to lock the first coupling elements alternatively to the second or third coupling elements when the bed is coupled to the support column or to the trolley.

6. The patient bed system according to claim 5, wherein the locking means comprise at least one locking element which is arranged adjustably on one of the coupling elements and which, in the engagement position of two coupling elements, engages into a clearance of the coupling element adjacent in each case, and in that the coupling elements have formed on them control cams, by means of which, during the operation of transferring the bed from the support column onto the trolley, or vice versa, the at least one locking element is shifted positively into the clearance or is shifted out of the latter.

7. The patient bed system according to claim 6, wherein the at least one locking element is designed as a two-armed rotatably mounted lever which has control edges which are intended to interact with the control cams and which are arranged on both sides of the fulcrum of the lever.

8. The patient bed system according to claim 6, wherein each first coupling element has arranged on it two locking elements, of which one is intended for locking the first coupling element to the second coupling element and the other is intended for locking the first coupling element to the third coupling element, and in that the control cams are designed for adjusting the locking elements on the second or the third coupling element.

9. The patient bed system according to claim 1, wherein the column-side coupling element is arranged on a column head adjustable via at least one actuating drive, and in that the sensor is connected to a control controlling the actuating drive of the column head.

* * * * *